United States Patent [19]

Bonaccorsi et al.

[11] Patent Number: 4,716,884

[45] Date of Patent: Jan. 5, 1988

[54] OVEN DOOR OF THE VENTILATED TYPE

[75] Inventors: Luigi Bonaccorsi; Piero Armanni; Giuliano Zanetti, all of Forlí, Italy

[73] Assignee: Zanussi Elettrodomestici S.p.A., Pordenone, Italy

[21] Appl. No.: 886,641

[22] Filed: Jul. 15, 1986

[30] Foreign Application Priority Data

Jul. 15, 1985 [IT] Italy ..... 45725 A/85

[51] Int. Cl.[4] ..... F23M 7/00

[52] U.S. Cl. ..... 126/198; 126/200

[58] Field of Search ..... 126/190, 198, 200, 21 R, 126/193, 213; 220/82 R; 219/343, 400, 522; 99/341

[56] References Cited

U.S. PATENT DOCUMENTS

| | | | |
|---|---|---|---|
| 3,057,341 | 10/1962 | Perl | 126/198 |
| 3,339,541 | 9/1967 | Evans | 126/200 |
| 3,692,015 | 9/1972 | Chase et al. | 126/200 |
| 3,855,994 | 12/1974 | Evans et al. | 126/198 |
| 3,893,442 | 7/1975 | Nuss | 126/198 |

FOREIGN PATENT DOCUMENTS

| | | |
|---|---|---|
| 3238441 | 4/1984 | Fed. Rep. of Germany . |
| 3104710 | 12/1984 | Fed. Rep. of Germany . |

*Primary Examiner*—Samuel Scott
*Assistant Examiner*—Noah Kamen
*Attorney, Agent, or Firm*—Wenderoth, Lind & Ponack

[57] ABSTRACT

An oven door includes a peripheral frame, an internal transparent pane adhesively secured to the frame and an external transparent pane releasably mounted on the frame. The frame has lower and upper rims formed with openings for the circulation of air through an interspace between the two panes. A profile member is secured to the upper rim of the frame and has a central handle. The profile member has an internal cavity communicating with the openings of the upper rim and with the interior of the oven chamber. First deflector elements within the internal cavity direct a flow of air from the interior of the oven into the interspace. Second deflector elements within the cavity define venturi-type passages for facilitating the escape of air from the interspace.

4 Claims, 5 Drawing Figures

OVEN DOOR OF THE VENTILATED TYPE

BACKGROUND OF THE INVENTION

The present invention relates to a door for a kitchen oven, particularly of the ventilated type, comprising a peripheral frame carrying two transparent panes, i.e. an inner pane and an outer pane.

Such transparent panes usually are spaced from one another by a frame interposed therebetween for creating an interspace or air chamber permitting the temperature of the outer pane to be reduced for safety reasons (U.S. Pat. No. 3,339,541). This solution is rather complicated from the viewpoint of its construction, as it requires numerous components, particularly fastener elements for securing the inner frame to an outer frame. In addition, this solution renders the cleaning of the internal surfaces of the panes and the replacement of the outer panel practically impossible during use. As a main problem, however, there remains the temperature of the outer pane. The solution represented by a closed air chamber between the two panes does not provide for sufficient insulation for ensuring a limited rise of the temperature of the outer pane for eliminating danger to the user.

There have thus been proposed doors having two or more transparent panes with interspaces therebetween and provided with passages effective to create a natural circulation of cooling air (U.S. Pat. Nos. 3,692,015, 3,855,994, 3,893,442). Doors of this type are capable of improving the situation with regard to the temperature of the outer pane, but do not eliminate the above noted inconveniences. In particular, the problem regarding cleaning may even by aggravated due to the fact that the air rising in the interspaces may entrain dust, fumes and the like which are then deposited on the internal surfaces of the panes. Several solutions have been offered for facilitating the dismounting and internal cleaning of the door (German Pat. Nos. 3,104,710 and 3,238,441), but in these cases the problem of cooling the door, and in particular its handle, has not been approached or at least has not been solved in a satisfactory manner.

Examination of the prior art makes it appear that the two problems, i.e. cooling of the door and its handle, and removability or replacability of the outer pane, are of mutually exclusive nature, so that their solution in a unitary structure would present considerable difficulties.

SUMMARY OF THE INVENTION

It is therefore an object of the invention to provide an oven door which permits the temperature of the outer pane to be effectively limited and at the same time permits the outer transparent panel or pane to be readily replaced by the use of an extremely simple, reliable and economical construction of the door as a whole.

The proposed solution is particularly advantageous for ovens of the ventilated type, i.e. for ovens provided with a fan for creating a forced air circulation around the oven chamber and discharging the air to the exterior at a location at the front surface of the oven.

The invention is directed to a door comprising a peripheral frame to which an internal transparent pane is adhesively secured and to which an outer transparent pane is removably attached. The frame has lower and upper boundary areas formed with passages for the circulation of air through an interspace defined between the two panes. The upper boundary area of the frame is provided with a profile member secured thereto and having a center portion thereof formed as a handle. The profile member is formed with an internal cavity communicating through respective slots with passages formed in the upper boundary area of the door and with the interior of the oven chamber. The cavity contains first deflector elements for directing an air flow originating from the interior of the oven around the oven chamber into the interspace between the two transparent panes, and second deflector elements defining venturi-type passages for facilitating the escape of the air from the interspace.

BRIEF DESCRIPTION OF THE DRAWINGS

These and other objects, advantages and characteristics of the invention will become more clearly evident from the following description, given by way of example with reference to the accompanying drawings, wherein.

DETAILED DESCRIPTION OF THE INVENTION

Figure 1:
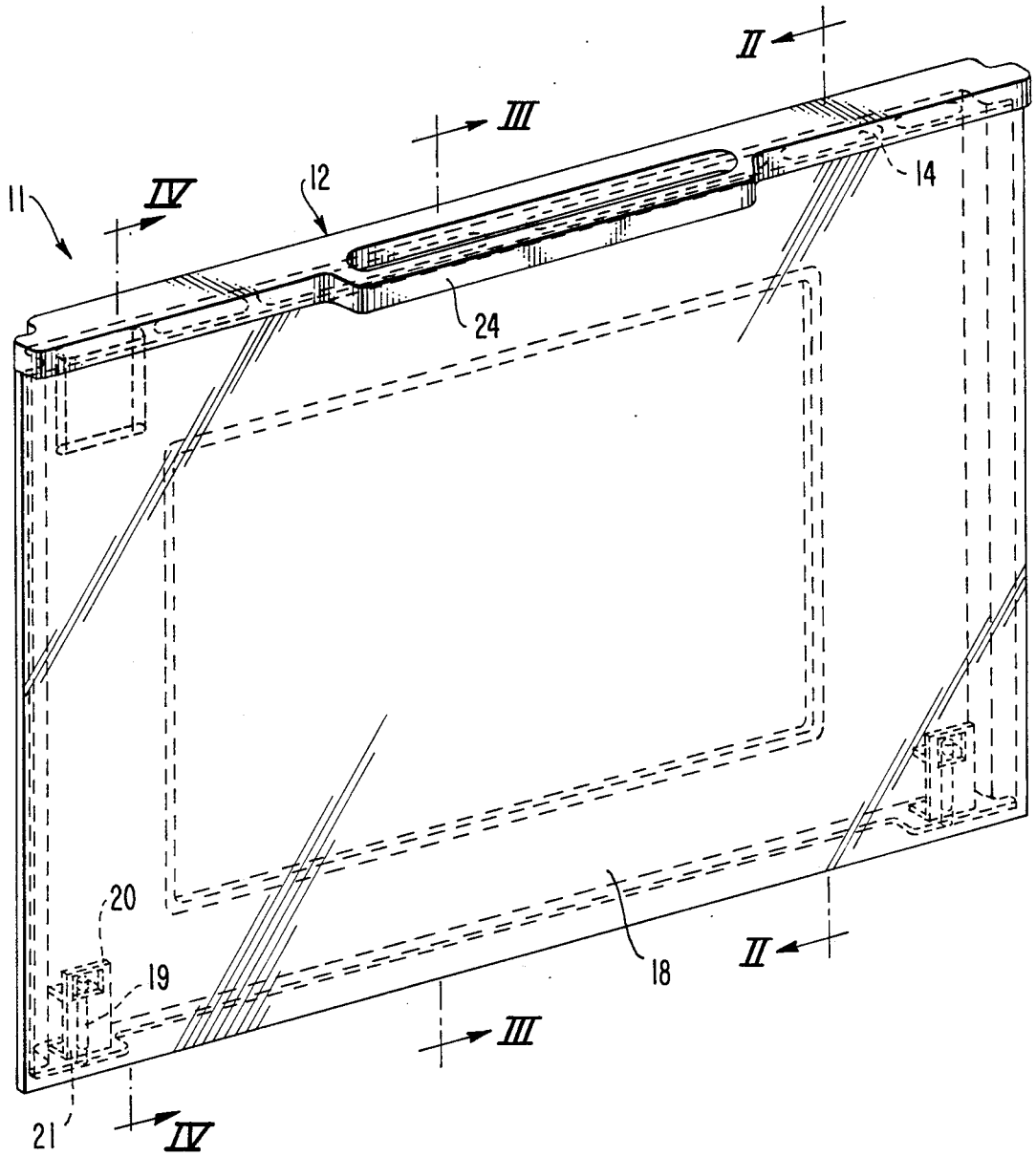
FIG. 1 is a perspective view of an oven door according to the invention.

The oven door 11 of the invention comprises an integral peripheral frame 12 formed of a wall facing towards the oven chamber and provided with a bent upper rim portion 13 extending towards the outer side of the door and terminating in an inverted U-shaped guide 15 extending over the full width of the door 11. Rim portion 13 is formed with slots 14, while a lower rim 16 of frame 12 is completely open. An opening of frame 12 facing towards the oven chamber is closed by a transparent pane 17 adhesively secured to the rim of the opening.

The outwards facing side of door 11 is provided with a further transparent pane 18 having an upper rim which is received in guide 15 of frame 12 and a lower rim releasably secured to frame 12 by means of two spring-loaded pins 19, one on each side, mounted in perforate brackets 20 adhesively secured to the inner surface of pane 18. Pins 19 cooperate with respective bores 21 formed in the lower rim of frame 12 (FIG. 1).

Transparent panes 17 and 18 are thus retained at spaced positions without the need of a spacer frame or other spacer elements so as to define therebetween an interspace 22 which is open at its lower end and, due to the presence of the slots 14 in upper rim portion 13, also is open at its upper end.

Figure 2:
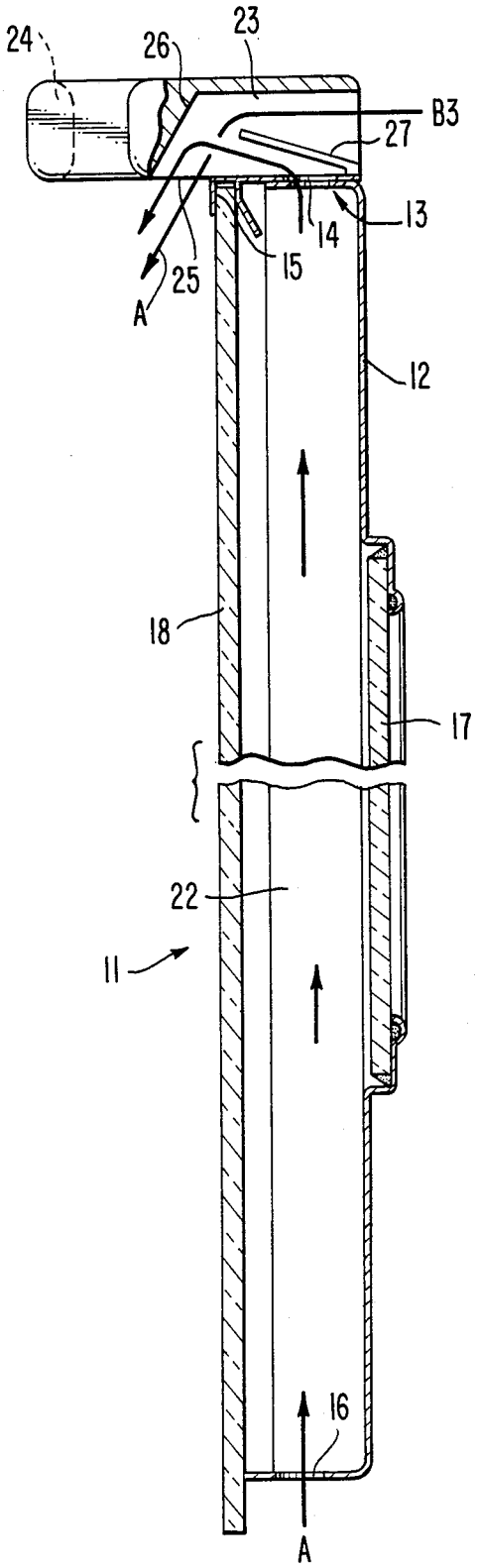
FIGS. 2, 3 and 4 are sectional views of respective details of the door of FIG. 1 taken along lines II—II, III—III, IV—IV thereof, respectively.
Figure 3:
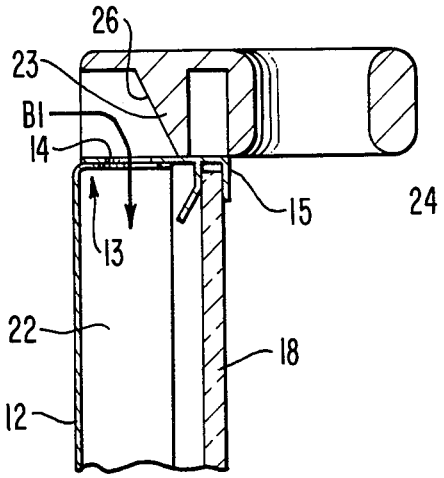
Figure 4:
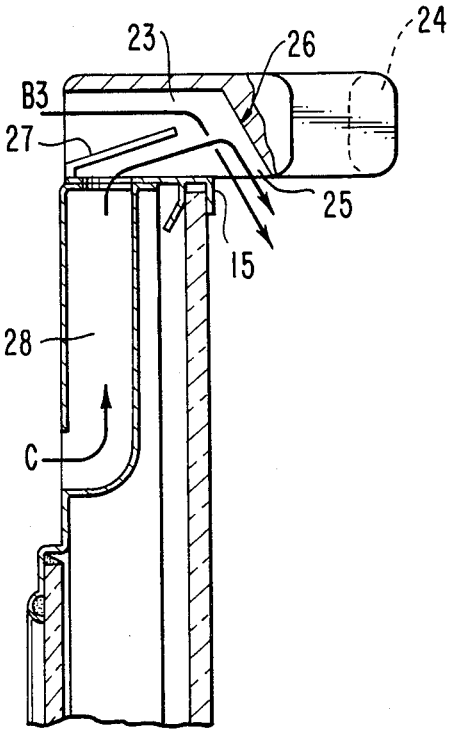

Secured to upper rim portion 13 of frame 12 is a hollow profile member 23 provided with a handle 24 at its center portion (FIGS. 2–4). The cavity of profile member 23 communicates through slots 14 with the interspace between panes 17 and 18, and with an upper portion of the around the area chamber oven chamber in which a fan is mounted in a per se known manner (not shown). At both sides of handle 24, profile member 23 is formed with front outlet openings 25 facing in a downward direction for air circulating through interspace 22 to escape therethrough. Secured within profile member 23 are first deflector elements 26 for directing a flow of air originating from the oven chamber into interspace 22, and second deflector elements 27 disposed in the air flow path in such a manner as to define venturi-type passages for facilitating the escape of the air from interspace 22. First deflector elements 26 substantially are vertical blades or surfaces. Second deflector elements 27 are angularly inclined blades defining respective convergent passages for air escaping from the interior of the oven around the oven chamber and a passage of substantially constant cross-section for air escaping from interspace 22. These passages join at openings 25. First deflector elements 26 are disposed in the central portion of profile member 23 at positions adjacent frame 12, while second deflector elements 27 are disposed at opposite lateral portions of profile member 23.

In addition, the door is provided with a passage 28 for the escape of fumes and vapors C from within the oven chamber (FIG. 4). A venturi effect created by deflector elements 26 produces a suction effect promoting the escape of vapors C so as to avoid the condensation thereof on cooler parts of the installation.

The construction according to the invention thus effectively and completely solves the problem of cooling door 11, as the entire surface of the door comes into contact with the air flow passing through the interspace between the two panes 17 and 18.

Figure 5:
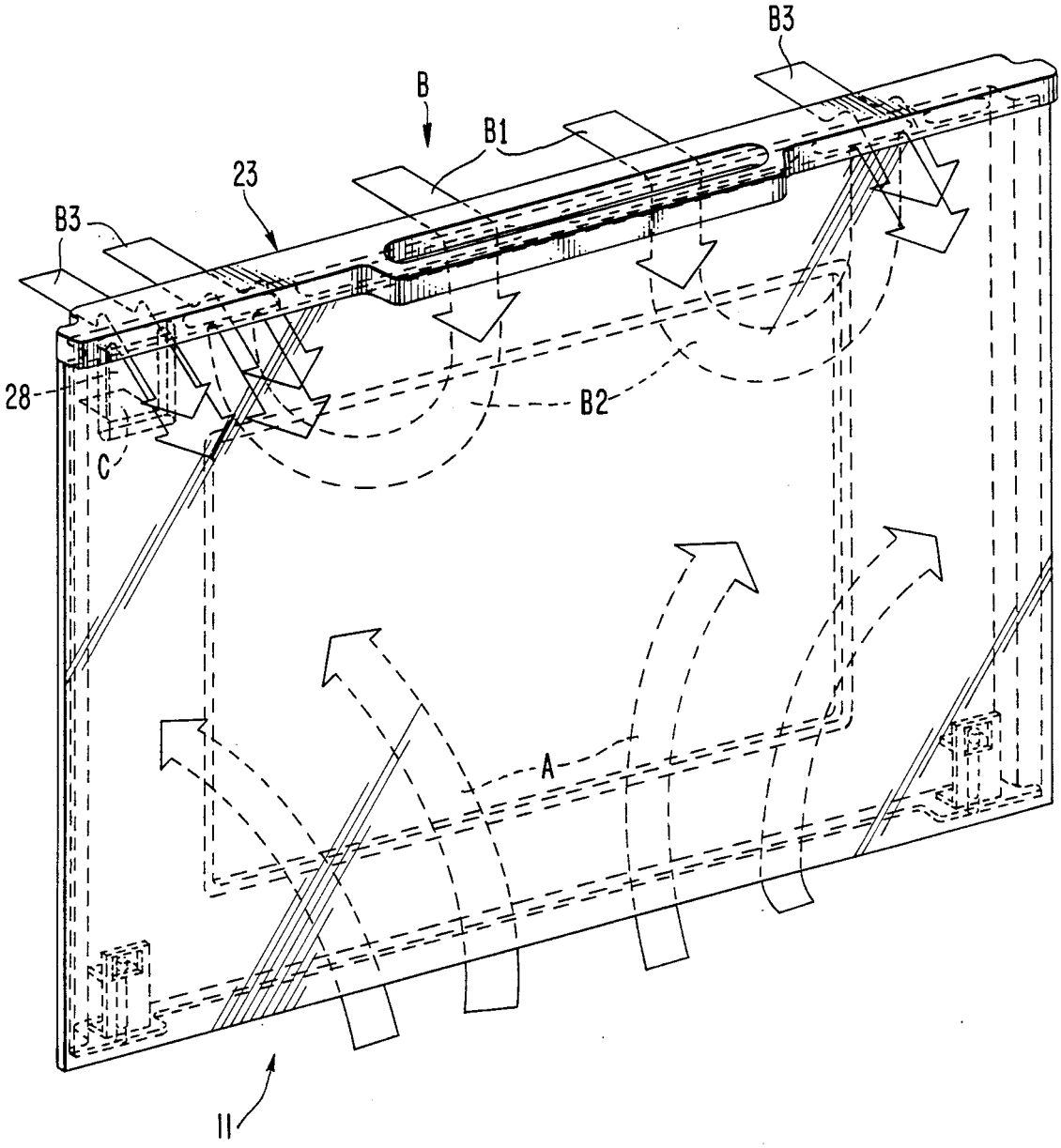
FIG. 5 is a diagrammatic illustration of the air flows in the interior of the door of FIG. 1.

As shown in FIGS. 2 and 5, a cooling air flow A, activated by the vacuum created by deflector element 27, enters interspace 22 through the open lower rim 16 of the door and escapes through the front openings 25 of profile member 23. An air flow B produced around the oven chamber by the action of the fan in the oven, and heated by heat emanating from the oven chamber, enters the cavity of profile member 23 over its full length. This heated air flow follows various flowpaths. A first central flow portion B1 at the location of handle 24 is directed downwards by deflector elements 26 into interspace 22 and meets the upflowing cooling air A therein to be deflected laterally so as to inhibit the heating of the handle and of the door area therebelow. Flow B1 is deviated laterally by flow A as shown at B2 and is discharged through openings 25. Second lateral portion B3 of flow B are discharged directly through openings 25 with cooling air A. Due to the presence of deflector elements 27 and the venturi effect created thereby, the lateral flows B3 promote the escape of the air from the interior of the door. The internal circulation of the oven door is otherwise clearly evident from FIG. 5.

Although the present invention has been described and illustrated with respect to preferred features thereof, it is to be understood that various changes and modifications may be made to the specifically described and illustrated features without departing from the scope of the present invention.

We claim:

1. An oven door of the ventilated type and comprising:

a peripheral frame;

an inner transparent pane secured to said frame to face an oven chamber when said door is mounted on an oven;

an outer transparent pane releasably mounted on said frame at a position spaced outwardly from said inner pane with respect to the oven chamber;

said frame having lower and upper rims formed with openings for the circulation of cooling air upwardly through an interspace between said inner and outer panes;

a profile member secured to said upper rim of said frame and having a handle;

said profile member having an internal cavity to receive a flow of air forced around the oven chamber by a fan and which is heated at an upper portion of the oven chamber, said internal cavity communicating through said openings in said upper rim with said interspace;

first deflector means within said internal cavity for directing a first portion of the flow of heated air away from said handle and into said interspace;

said profile member having front outlet openings extending from said internal cavity to the exterior of the door, such that a second portion of the flow of heated air passes through said internal cavity and is discharged directly through said front outlet openings; and second deflector means within said internal cavity forming venturi passages for said second portion of said flow of heated air and thereby for promoting the flow of said cooling air through said interspace and the escape of said cooling air flow and said first portion of said heated air flow from said interspace through said front outlet openings.

2. An oven door as claimed in claim 1, wherein said first deflector means are disposed in a central portion of said profile member as positions adjacent said frame, and said second deflector means are disposed in lateral portions of said profile member.

3. An oven door as claimed in claim 1, wherein said first deflector means is in the form of a substantially vertical surface, said second deflector means are formed as angularly inclined blades defining respective convergent passages for air escaping from the interior of the oven and passages of substantially constant cross-section for air escaping from said interspace between said two panes, said passages joining one another in said front outlet openings formed in said profile member.

4. An oven door as claimed in claim 1, further comprising a passage separate from said interspace for discharging fumes and vapors from the oven interior through said internal cavity and said front outlet openings.

* * * * *